United States Patent [19]

Stormon

[11] Patent Number: 4,927,144

[45] Date of Patent: May 22, 1990

[54] PUTTER

[76] Inventor: Robert D. Stormon, 2103 Divot La., Palm Springs, Calif. 92264

[21] Appl. No.: 390,082

[22] Filed: Aug. 7, 1989

[51] Int. Cl.[5] ..... A63B 53/02; A63B 53/08

[52] U.S. Cl. ..... 273/80 A; 273/80 C; 273/80.2; 273/167 G; 273/169; 273/171

[58] Field of Search ..... 273/167–175, 273/80.2–80.8, 80 B, 80 C, 77 R, 77 A, 80.1, 80 A

[56] References Cited

U.S. PATENT DOCUMENTS

| | | | |
|---|---|---|---|
| 1,219,417 | 3/1917 | Vories | 273/79 |
| 1,429,569 | 9/1922 | Craig | 273/79 |
| 1,594,850 | 8/1926 | Perkins | 273/79 |
| 1,841,062 | 1/1932 | Schavoir | 273/80.3 |
| 1,983,158 | 12/1934 | Young | 273/80.4 |
| 2,520,702 | 8/1950 | Verderber | 273/79 |
| 2,530,446 | 11/1950 | Beardsley | 273/79 |
| 3,305,235 | 2/1967 | Williams | 273/81.2 |
| 3,519,271 | 7/1970 | Smith | 273/167 K |
| 3,601,399 | 8/1971 | Agens | 273/79 |
| 3,980,301 | 9/1976 | Smith | 273/80.2 |
| 4,077,633 | 3/1978 | Studen | 273/164 |
| 4,162,074 | 7/1979 | Thomson | 273/175 |
| 4,506,888 | 3/1985 | Nardozzi | 273/80.1 |
| 4,695,054 | 9/1987 | Tunstall | 273/171 |
| 4,697,813 | 10/1987 | Inoue | 273/171 |

*Primary Examiner*—Edward M. Coven

*Assistant Examiner*—Sebastiano Passaniti

*Attorney, Agent, or Firm*—Duane C. Bowen

[57] ABSTRACT

The putter has a head with a downwardly open cavity and a plate closing the cavity and secured by screws. The club head has a top opening at its heel end and the plate has a through opening in its toe end. The shaft has an extension at its lower end including a first portion bent to pass downwardly through the top portion, a second portion slanting downwardly between the openings, and a third portion extending downwardly into the through opening where it is welded in place. The shaft is of smaller diameters at locations near where it passes through the openings. The shaft is smaller than the top opening so that the shaft can flex within the top opening and give upon initial impact with the golf ball and then later recoil against the golf ball. The club head has a center of gravity located at the intersection of the longitudinal axis of the second portion of the shaft and of a diagonal line bisecting the angle formed by a line from the grip to the through opening and by the centerline of the main portion of the shaft. The club head weight is balanced vertically relative to the centerline of the second portion of the shaft. The center of gravity is equally distant from the two smaller diameter portions of the shaft. The sight is wedge shaped and arranged to show apparent distortion up on misalignment of the club head.

8 Claims, 3 Drawing Sheets

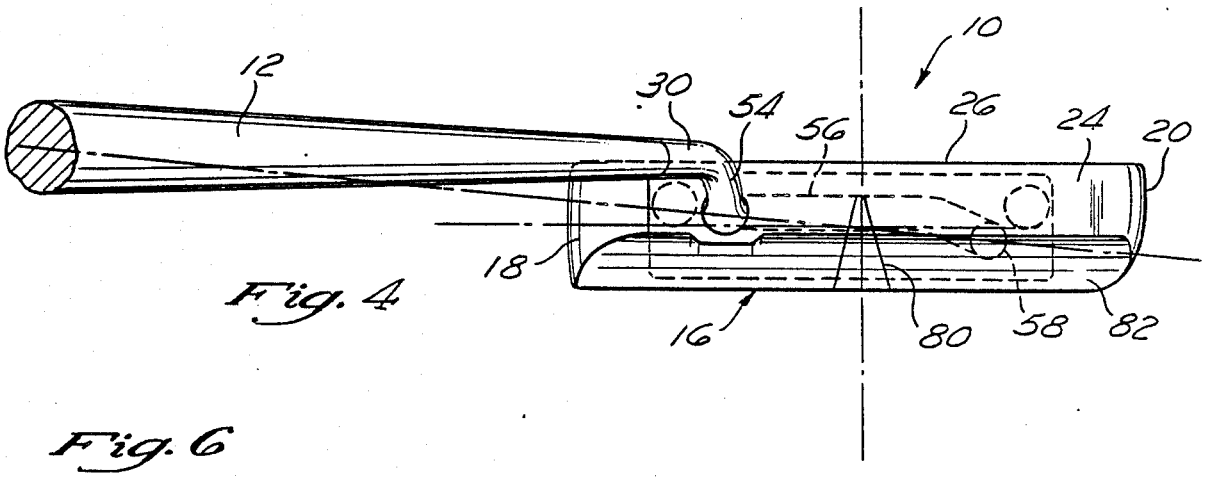
Fig. 4
Fig. 6
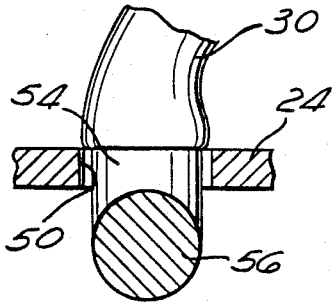
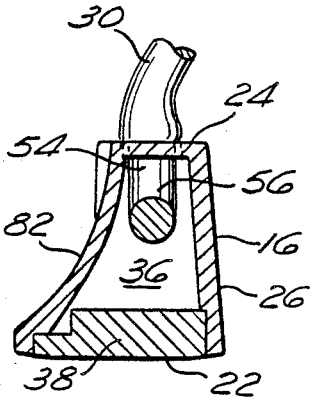
Fig. 7
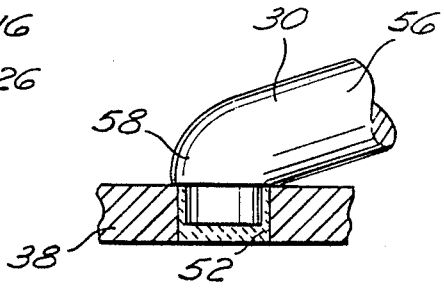
Fig. 8
Fig. 5
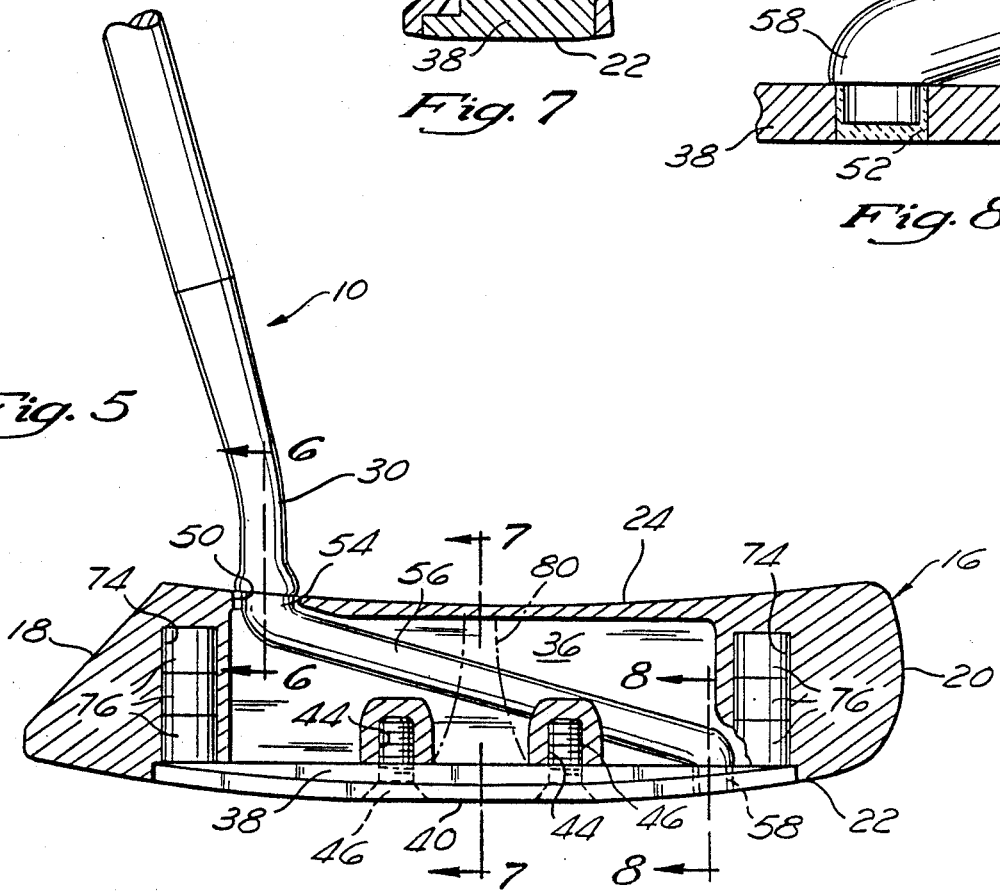

PUTTER

BRIEF SUMMARY OF THE INVENTION, BACKGROUND AND OBJECTIVES

My invention relates to an improvement in putters better handling the forces involved in putting a golf ball.

Putters can have various characteristics. I consider it important to achieve the following characteristics in a putter:

(a) To obtain the look of a heel shafter putter with an unobstructed view of the sight line, rather than the view associated with a center shafted putter.

(b) To reduce unwanted torques that occur during accelerations and decelerations during the stroke of a putter so that the golfer will have less forces to deal with in bringing the club head back to the golf ball for impact.

(c) To perfect a club that will more efficiently absorb a portion of the energy during the golf club swing and will redirect the energy to the golf ball during impact so as to provide a smoother transition of the golf ball from its stationary position to its final free roll.

(d) To provide a sighting system that will better enable the golfer to orient the club head before and during the swing.

(e) To perfect a putter that is geometrically clean of features that would tend to distort or to distract the attention from the sight and the golf ball.

(f) To provide a club that will permit adjustment of club weight without distorting the total balance of the club.

It is an objective of my invention to devise a putter that has the foregoing desirable features. Another objective is to attach the lower end of the shaft to the toe end of the club head in a concealed manner and in a manner permitting some flexing between the lower portion of the shaft and the heel end of the club head. Another objective is to provide a suitable method of manufacturing such a club and method of shaft-head attachment.

My invention will be best understood, together with additional advantages and objectives thereof, when read with reference to the drawings.

DRAWINGS

FIG. 4 is a top view taken on line 4—4 of FIG. 1.

FIG. 5 is a side view, partly in section, taken on line 5—5 of FIG. 1.

FIGS. 6, 7 and 8 are enlarged elevational views, partly in section, taken on lines 6—6, 7—7, and 8—8 of FIG. 5.

Figure 1:
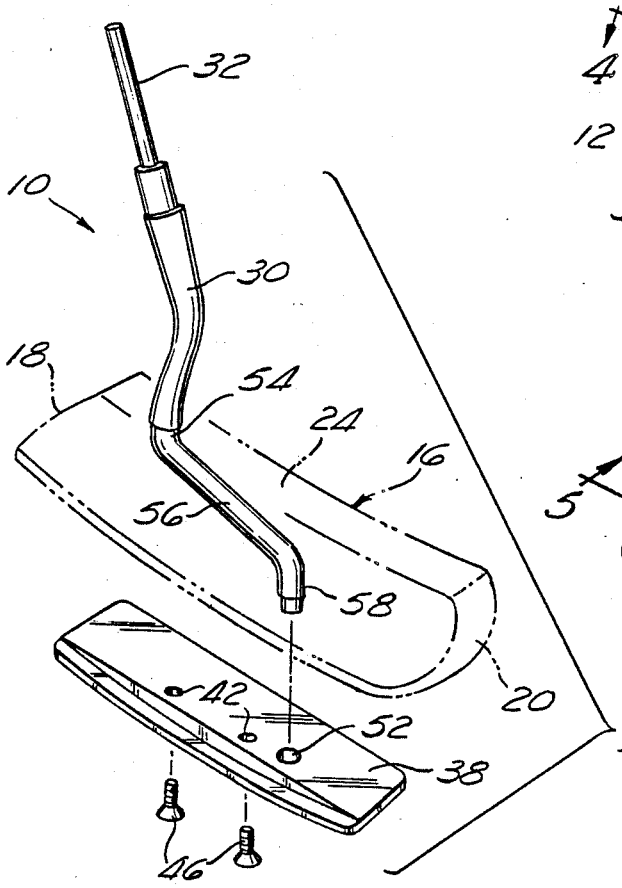
FIG. 1 is a perspective view of the club head and a part of the club shaft of a Putter showing a specific embodiment of my invention.
Figure 2:
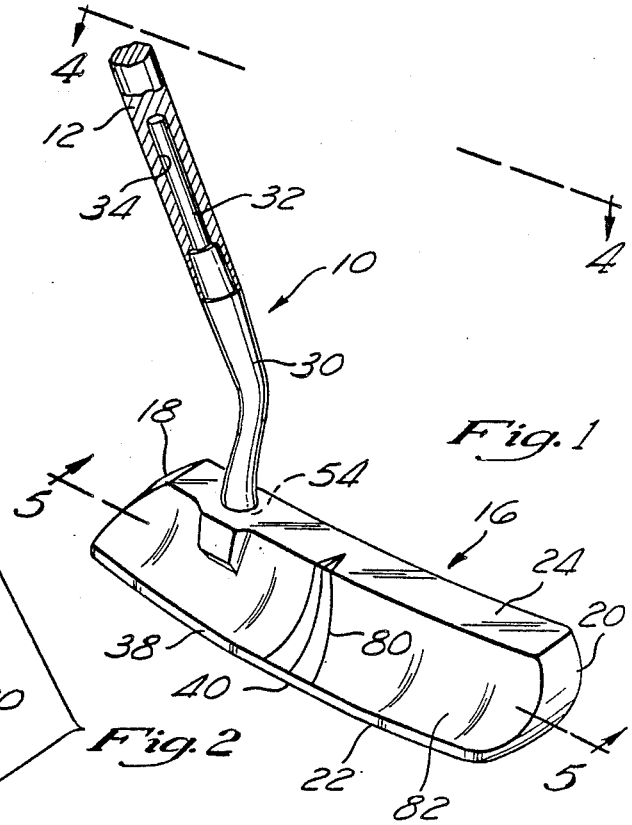
FIG. 2 is an exploded perspective view showing the club head in phantom and showing a shaft extension, a closure plate and fastening screws in full lines.
Figure 3:
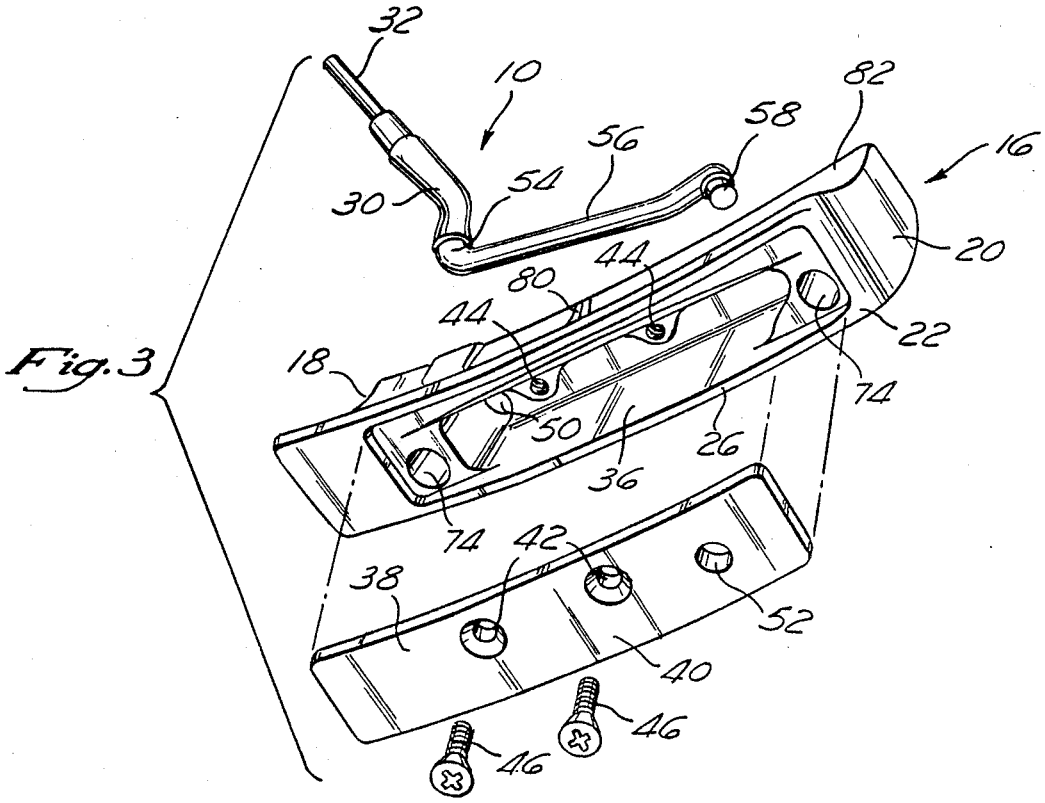
FIG. 3 is an exploded perspective view showing the club head, shaft extension, closure plate and fastening screws.
Figures 9, 10, 11:
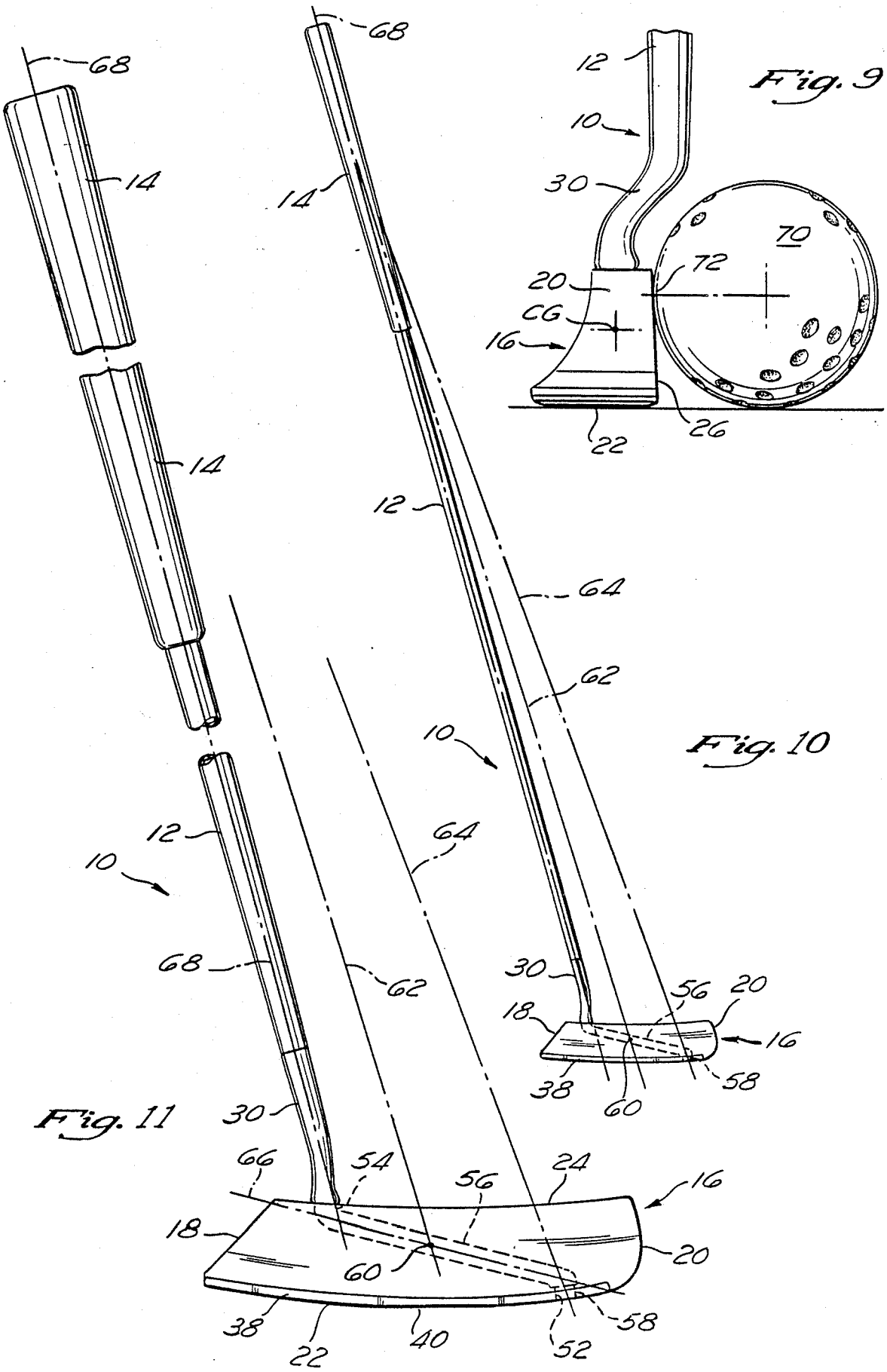

FIG. 9 is a view from the toe end of the putter showing a golf ball supported on a surface and showing the putter in contact with the golf ball.

FIG. 10 is a side elevational view of the putter.

FIG. 11 is like FIG. 10 but is shown on an enlarged scale. Part of the shaft is broken away.

DESCRIPTION

To provide orientation I will first list some parts of my putter 10 that are in common with other golf clubs and putters. An elongated shaft 12 has a grip 14 at its upper end and shaft 12 is attached to a club head 16 at the lower end of the shaft. Club head 16 has a heel end 18, a toe end 20, a sole 22, an upper surface 24, and a face 26.

Shaft 12 has an extension 30 at its lower end. Extension 30 has a tang 32 which is suitably secured in a recess 34 in the major upper portion of shaft 12. Club head 16 has a downwardly open cavity 36 elongated in a heel-to-toe direction. A plate 38 fits and closes cavity 36 at the sole 22 of said club head. Plate 38 may be flattened at 40 and would be horizontal in the ideal position of the putter when the golf ball is addressed. Plate 38 has openings 42. When plate 38 is to be installed, it is located in proper position and holes 44 are tapped into head 16. Then screws 46 are disposed in openings 42 and screwed into holes 44 to hold plate 38 in place.

Club head 16 has a generally vertically extending top opening 50 in its heel end 18 which leads to cavity 36. Plate 38 has a generally vertically extending through opening 52 in its toe end. Note that top opening 50 is closer to club face 26 than is through-opening 52.

Shaft extension 30 includes a first portion 54 bent to pass downwardly through top opening 50, a second portion 56 slanting downwardly in cavity 36 toward toe end 20, and a third portion 58 extending downwardly into through opening 52 in plate 38 where it is welded in place.

The procedure in installing shaft extension 30 is to pass first shaft extension portion 54 upwardly through top opening 50, to insert third shaft extension portion 58 in through opening in plate 38 and to fasten plate 38 in place by screws 46. Club head 16 had previously been tapped to provide holes 44 for securing of screws 46. Then a fixture is used to hold first shaft extension portion in the proper position relative to club head 16 in general and relative to top opening 50 in particular. Top opening 50 must be larger than first shaft extension portion 54 so that shaft extension 30 can flex relative to club head 16. Preferably top opening 50 is a minimum of 0.074" larger in diameter than the diameter of the adjacent section of first shaft extension portion 54. Before welding third shaft extension portion 58 in through opening 52 in plate 38, the tooling fixture is used to locate first shaft extension portion 54 centered in top opening 50. The 0.074" difference between the diameter of top opening 50 and the portion of shaft extension 30 extending through the top opening 50 provides room for shaft extension 30 to flex relative to club head 16 during the stroke and when the golf ball is struck (when club head 16 gives upon initial impact and then recoils against the golf ball).

Second shaft extension portion preferably descends at 15.5° to the horizontal when club head 16 has an ideal position in addressing the golf ball with flat sole surface 40 on plate 38 horizontally disposed. Note in looking at shaft extension 30 from above that extension 30 bends rearwardly, away from face 26 forwardly of top opening 50 and again forwardly of through opening 52.

Shaft extension first portion 54 at its location passing through top opening 50 and shaft extension third portion 58 are of reduced diameter relative to the remainder of shaft extension 30 so that during the stroke and when a golf ball is struck by face 26, torquing or flexing of shaft extension 30 is equally shared by these two reduced diameter portions, which are also equally spaced from the center of gravity 60 of club head 16. Preferably the reduced diameter portions are each 0.250" in diameter. This would be ideal in stainless steel but might vary in other metals.

Center of gravity 60 lies on the longitudinal axis of second shaft extension portion 56 at the intersection with a diagonal line 62. Diagonal line 62 bisects the angle formed by a line 64 from the grip to the center of through opening 52 where third shaft extension portion is welded and by the centerline 68 of the main portion of shaft 12.

Half of the weight of club head 16 is disposed above and half the weight of club head 16 is disposed below an oblique plane that extends through the longitudinal axis 66 of the second portion 56 of shaft extension 30, the oblique plane forming straight horizontal lines in vertical planes at right angles to the longitudinal axis 66 of the shaft extension second portion 56. This means that during generally horizontal travel of the club head during a stroke the club head 16 does not tend to rotate about the longitudinal axis 66 of second shaft extension portion 56.

A purpose of the connection of the shaft to the toe end 20 of club head 16 (by connecting shaft extension to sole plate 38 at the location of through opening 52) is to permit flexing of club head relative to shaft 12 within the limits of play between top opening 50 and the portion of shaft extension 30 passing therethrough, thereby to reduce unwanted torques during the putter stroke and impact with the golf ball. Thus, the golfer has lesser forces to contend with between the time the golf ball is addressed, the backswing and the foreswing until club head 16 is brought back to the intended target line at impact. This helps absorb a portion of the energy involved in the stroke and redirects it toward the intended target. This more accurately smooths the transition from the standing golf ball to the golf ball in free roll.

Observing a golf ball 70 in position to be addressed or struck by face 26 of club head 16, the approximate point of impact 72 is well above the oblique plane above described, that is, well above the level of center of gravity 60. It is difficult to accurately depict this, particularly at the time of golf ball impact because the golf ball 70 will be depressed somewhat into the turf and the club head 16 desirably will be somewhat above the turf, but, in any case, the point of impact 72 with the golf ball will be somewhat above the level of the center of gravity 60 of club head 16. At impact, the face 26 of club head 16 tips back slightly. The face 26 is given about 2 degrees natural loft. The tipping of the face 26 on impact adds to the 2 degrees natural loft and may reach 5 degrees in a hard stroke. The tilt allows the ball 70 to be lifted slightly at the moment of impact, reducing the drag of the ball caused by its contact with the turf. Meanwhile, the recoil to the tipping action on face 26 causes an over-the-top spin as ball 70 releases from head 16, which reduces the length of the skid and reduces the length until free roll of golf ball 70 is achieved. The net result is a very smooth and predictable roll. In contrast, the fixed 3½ degrees to six degrees of lofts of other putters has only the flex of the shaft. That shaft flex, above the hosel, tends to reduce the loft of the face, which is opposite what is needed to obtain proper motion of the golf ball.

The flex points of reduced diameter of shaft extension 30 being equally distant on either side of center of gravity 60, the effect is for the ball 70 to go straighter. The mis-hit ball 70 tends to create more leverage with less head weight behind the ball if hit on the heel side of the center of gravity 60 and tends to create less leverage with more head weight behind the ball if hit on the toe side of the center of gravity 60.

There are two weight cavities 74 each with a capacity of three to seven gram weights 76. These weights should be added in sets as desired by the user. These weights usually are added so they are located vertically in the center of cavities 74. Torque can be increased in the heel of the head 16 by the weight being placed in the lower parts of cavities 74 or torque can be increased in the toe of the head 16 by the weight being placed in the upper part of the cavities, because of their relationship to the longitudinal axis 66 of the second portion 36 of shaft extension 30. Weight cavities 74 are outboard of cavity 36 endwise of head 16.

It might be possible to provide shaft extension 30 and plate 38 in one piece by precision casting but the cost would seem to be too high to justify use of that technology for a putter.

A wedge-shaped sight 80 is enscribed on the back 82 of the club head 16. The back 82 is concavely curved. When the putter 10 is placed in an ideal position addressing golf ball 70 and the golfer's eye is vertically above the point of contact 72 of club head face 26 with golf ball 70, then sight 80 will have an ideal wedge shape. In other eye positions, sight 80 will show distortion from such ideal wedge shape.

The normal length of putter 10 from the ground to the top of shaft 12 will be thirty-three to thirty-seven inches. Grip 14 may extend downwardly about ten inches from the top of shaft 12. Referring particularly to FIG. 10, line 64 contacts grip 14 about seven inches from the top of shaft 12 which is about the lower end of a golfer's hands on such a grip 14. Whereas line 64 contacts grip 14 at that point, line 64 does not cross the center line 68 of shaft 12 until a point at the upper end of grip 14.

Having thus described my invention, I do not wish to be understood as limiting myself to the exact details shown and described herein. Instead I wish also to cover those modifications there of which also will occur to those skilled in the art and which properly are within the scope of my invention.

I claim:

1. The improvement in a golf putter having an elongated shaft with a grip at its upper end and having a club head with a heel end, a toe end, a sole, an upper surface, and a face comprising:

(a) said club head having a downwardly open cavity elongated in a heel-to-toe direction and having a plate closing said cavity at said sole of said club head and secured to said club head, (b) said club head having a generally vertically extending top opening to said cavity in said heel end of said club head and said plate having a generally vertically extending through opening in said toe end thereof, (c) said shaft having an extension at its lower end below the main portion of said shaft including a first portion bent to pass downwardly through said top opening, having a second portion slanting downwardly in said cavity toward said toe end, and having a third portion extending downwardly into said through opening in said plate where it is welded to said plate, (d) said shaft at its location passing through said top opening being smaller in cross-section than said top opening whereby when a golf ball is struck by said face said first portion of said shaft has room in said top opening to flex relative to said club head whereby said head gives upon initial impact with said golf ball and then recoils against said golf ball, (e) said club head having a center of gravity located at the intersection of the longitudinal axis of said second portion of said shaft and of a diagonal line bisecting the angle formed by a line from said grip to said through opening and by the centerline of said main portion of said shaft, said extension including a first reduced diameter portion above and adjacent to said top opening of said club head and said third portion of said extension being equally reduced in diameter and said reduced diameter portions being substantially equally spaced from said center of gravity whereby torquing of said shaft upon impact with a golf ball is equally shared by said reduced diameter portions, and (f) half the weight of said club head being disposed above and half the weight of said club head being disposed below an oblique plane that extends through said longitudinal axis of said second portion of said shaft extension, said oblique plane forming straight horizontal lines in vertical planes at right angles to said longitudinal axis of said second portion of said shaft extension, whereby during generally horizontal travel of said club head during a stroke, said club head does not tend to rotate about said longitudinal axis of said second portion of said shaft extension.

2. The improvement in a golf putter having an elongated shaft with a grip at its upper end and having a club head with a heel end, a toe end, a sole, an upper surface, and a face, comprising:

(a) said club head having a downwardly open cavity elongated in a heel-to-toe direction and having a plate closing said cavity at said sole of said club head and secured to said club head, (b) said club head having a generally vertically extending top opening to said cavity in said heel end of said club head and said plate having a generally vertically extending through opening in said toe end thereof, (c) said shaft having an extension at its lower end below the main portion of said shaft including a first portion bent to pass downwardly through said top opening, having a second portion slanting downwardly in said cavity toward said toe end, and having a third portion extending downwardly into said through opening in said plate where it is welded to said plate, (d) said shaft at its location passing through said top opening being smaller in cross-section than said top opening whereby when a golf ball is struck by said face said first portion of said shaft has room in said top opening to flex relative to said club head whereby said head gives upon initial impact with said golf ball and then recoils against said golf ball, and (e) said club head having a center of gravity located at the intersection of the longitudinal axis of said second portion of said shaft and of a diagonal line bisecting the angle formed by a line from said grip to said through opening and by the centerline of said main portion of said shaft, said extension including a first reduced diameter portion near to said top opening in said club head and said third portion of said extension being equally reduced in diameter and said reduced diameter portions being substantially equally spaced from said center of gravity whereby torquing of said shaft upon impact with a golf ball is equally shared by said reduced diameter portions.

3. The improvement in a golf putter having an elongated shaft with a grip at its upper end and having a club head with a heel end, a toe end, a sole, an upper surface, and a face, comprising:

(a) said club head having a downwardly open cavity elongated in a heel-to-toe direction and having a plate closing said cavity at said sole of said club head and secured to said club head, (b) said club head having a generally vertically extending top opening to said cavity in said heel end of said club head and said plate having a generally vertically extending through opening in said toe end thereof, (c) said shaft having an extension at its lower end below the main portion of said shaft including a first portion bent to pass downwardly through said top opening, having a second portion slanting downwardly in said cavity toward said toe end, and having a third portion extending downwardly into said through opening in said plate where it is welded to said plate, and (d) said shaft at its location passing through said top opening being smaller in cross-section than said top opening whereby when a golf ball is struck by said face said first portion of said shaft has room in said top opening to flex relative to said club head whereby said head gives upon initial impact with said golf ball and then recoils against said golf ball.

4. The improvement in a golf putter having an elongated shaft with a grip at its upper end and having a club head with a heel end, a toe end, a sole, an upper surface, and a face, comprising:

(a) said club head having a downwardly open cavity elongated in a heel-to-toe direction and having a plate closing said cavity at said sole of said club head and secured to said club head, (b) said club head having a generally vertically extending top opening to said cavity in said heel end of said club head, (c) said shaft having an extension at its lower end below the main portion of said shaft including a first portion bent to pass downwardly through said top opening, having a second portion extending in said cavity toward said toe end, and having a third portion extending downwardly and secured to the toe end of said plate, and (d) said shaft at its location passing through said top opening being smaller in cross-section than said top opening whereby when a golf ball is struck by said face said first portion of said shaft has room in said top opening to flex relative to said club head whereby said head gives upon initial impact with said golf ball and then recoils against said golf ball.

5. The improvement in a golf putter having an elongated shaft with a grip at its upper end and having a club head with a heel end, a toe end, a sole, an upper surface, and a face, comprising:

(a) said club head having a downwardly open cavity elongated in a heel-to-toe direction and having a plate closing said cavity at said sole of said club head and secured to said club head, (b) said club head having a generally vertically extending top opening to said cavity in said heel end of said club head, (c) said shaft having an extension at its lower end below the main portion of said shaft including a first portion bent to pass downwardly through said top opening, having a second portion extending in said cavity toward said toe end, and having a third end portion secured to the toe end of said plate, and (d) said shaft at its location passing through said top opening being smaller in cross-section then said top opening whereby when a golf ball is struck by said face said first portion of said shaft has room in said top opening to flex relative to said club head whereby said head gives upon initial impact with said golf ball and then recoils against said golf ball.

6. The putter of claim 5 in which said club head has two weight cavities, one weight cavity being located beyond the heel end of said downwardly open cavity and the other cavity being located beyond the toe end of said downwardly open cavity endwise of said club head whereby torque can be increased and decreased in the heel and toe of said club head.

7. The putter of claim 5 in which during addressing of a golf ball in a normal manner by said face, said golf ball first touches said face above the level of the center of gravity of said club head.

8. The putter of claim 5 in which the longitudinal axis of said second portion of said extension of said shaft in the normal position of said club head in addressing a golf ball makes an angle with the horizontal of substantially 15.5°.

* * * * *